US005721308A

United States Patent [19]

Yamamoto et al.

[11] Patent Number: 5,721,308

[45] Date of Patent: Feb. 24, 1998

[54] PITCH BASED CARBON FIBER AND PROCESS FOR PRODUCING THE SAME

[75] Inventors: Iwao Yamamoto, Kagawa; Akira Nakagoshi, Tokyo; Akihiko Yoshiya, Kagawa; Kazuo Shirosaki, Kitakyushu, all of Japan

[73] Assignee: Mitsubishi Chemical Corporation, Tokyo, Japan

[21] Appl. No.: 492,872

[22] Filed: Jun. 20, 1995

[51] Int. Cl.[6] ..... D01F 9/12

[52] U.S. Cl. ..... 524/495; 423/447.2; 428/367

[58] Field of Search ..... 423/447.2; 428/367, 428/408; 524/495, 496

[56] References Cited

U.S. PATENT DOCUMENTS 4,818,612 4/1989 Hara et al. .
4,923,648 5/1990 Hara et al. .
5,213,677 5/1993 Yamamoto et al. .
5,266,294 11/1993 Schultz et al. ..... 423/447.2
5,348,719 9/1994 Yamamoto et al. .
5,540,905 7/1996 Naito et al. ..... 423/442.6

*Primary Examiner*—Michael Lewis
*Assistant Examiner*—Stuart L. Hendrickson
*Attorney, Agent, or Firm*—Oblon, Spivak, McClelland, Maier & Neustadt, P.C.

[57] ABSTRACT

A pitch based carbon fiber, having a thermal conductivity in the direction of the fiber axis of from 500 to 1,500 W/m·K, a tensile modulus of at least 85 ton/mm$^2$, a compression strength of at least 35 kg/mm$^2$, a laminated layer thickness, Lc, of graphite crystallites of from 30 to 50 nm, and a ratio thereto of a spread, La, of graphite crystallites in the direction of the layer plane, of at least 1.5, has high thermal conductivity, excellent compression strength and an excellent tensile modulus of elasticity. When a cross section of said fiber in the direction of the fiber axis is observed by a polarization microscope with 1,000 X magnifications, the domain size as observed is at most 500 nm.

5 Claims, 1 Drawing Sheet

PITCH BASED CARBON FIBER AND PROCESS FOR PRODUCING THE SAME

DETAILED DESCRIPTION OF THE INVENTION

1. Field of Industrial Application

The present invention relates to a pitch based carbon fiber and a pitch based carbon fiber woven fabric, and a process for producing them.

A pitch based carbon fiber and its woven fabric produced by the present invention have high strength and high elasticity and exhibit a characteristic of high thermal conductivity, and they are useful as structural materials for space ships for which heat shock resistance is required, or as heat-dissipating materials for high energy density electronic devices.

2. Prior Art

High performance carbon fibers are generally classified into PAN-based carbon fibers prepared from polyacrylonitrile (PAN) as starting material and pitch-based carbon fibers prepared from pitches as starting material, and they are widely used as e.g. materials for aircrafts, materials for sporting goods and materials for buildings, by virtue of their characteristics such as high specific strength and high specific modulus of elasticity, respectively.

However, in addition to the above mechanical properties, high thermal conductivity is required for application to e.g. materials for space crafts for which heat shock resistance and dimensional stability under a large temperature distribution are required, or heat-dissipating materials for electronic devices for which high energy densification continues to progress. Thus, many studies have heretofore been made to improve thermal conductivity of carbon fibers.

However, the thermal conductivity of commercially available PAN-based carbon fibers is less than 200 W/m·K. On the other hand, it has been generally confirmed that with pitch based carbon fibers, high thermal conductivity can readily be accomplished as compared with PAN-based carbon fibers. However, the thermal conductivity of commercially available pitch based carbon fibers is usually less than 700 W/m·K.

Recently, a method has been proposed in which carbon fibers having higher thermal conductivity are produced by regulating the softening point of the pitch, the spinning temperature and the baking temperature (Japanese Unexamined Patent Publications No. 242919/1990, No. 163318/1992 and No. 163319/1992).

However, there has been no report on a carbon fiber in which the thermal conductivity is as high as from 500 to 1,500 W/m·K, and at the same time, the tensile modulus of elasticity is at least 85 ton/mm$^2$ and the compression strength is as high as at least 35 kg/mm$^2$, or a carbon having a high tensile strength, in which the tensile strength is at least 360 kg/mm$^2$, and a process for their production.

Nor is there a report on a fabric prepared by weaving a carbon fiber having the above-mentioned properties.

PROBLEM TO BE SOLVED BY THE INVENTION

As described above, carbon fibers having high thermal conductivity are being developed. However, the properties are still inadequate with respect to the strength and the modulus of elasticity. Accordingly, they are inadequate in the processability or the strength characteristic in the application field, and they are not readily useful. Thus, improvement in this regard has been desired.

MEANS TO SOLVE THE PROBLEM

The present inventors have studied strenuously to solve the above problem. As a result, they have found it possible to solve the problem by graphitizing under special conditions a starting material carbon fiber adjusted so that the ratio of a spread La of graphite crystallites in the direction of layer plane to the laminated layer thickness Lc of graphite crystallites (La/Lc) and the domain size would be at proper levels, and the present invention has been accomplished.

Namely, the object of the present invention is to provide a carbon fiber which has high thermal conductivity and which is excellent in compression strength and tensile modulus of elasticity simultaneously, and various materials employing it. Such an object can be readily accomplished by a pitch based carbon fiber characterized in that its thermal conductivity in the direction of fiber axis is from 500 to 1,500 W/m·K, its tensile modulus is at least 85 ton/mm$^2$, its compression strength is at least 35 kg/mm$^2$, the laminated layer thickness Lc of graphite crystallites is from 30 to 50 nm, the ratio thereto of a spread La of graphite crystallites in the direction of layer plane (La/Lc) is at least 1.5, and when its cross section in the direction of fiber axis is observed by a polarization microscope with 1,000 magnifications, the domain size as observed is substantially at most 500 nm.

Now, the present invention will be described in detail.

There is no particular restriction as to the spinning pitch to be used for the present invention to obtain the carbon fiber, so long as it is capable of presenting an optically anisotropic carbon fiber and it has readily orientable molecular species formed therein.

The carbonaceous material to be used to obtain such spinning pitch, may, for example, be coal tar, coal tar pitch, a liquefied product of coal, petroleum-derived heavy oil, tar, pitch or a polymerization reaction products of naphthalene or anthrathene obtained by a catalytic reaction. These carbonaceous materials contain impurities such as free carbon, insoluble coal, an ash content and a catalyst. It is advisable to preliminarily remove such impurities by a conventional method such as filtration, centrifugal separation or sedimentation separation by means of a solvent.

Further, the carbonaceous material may be subjected to pretreatment by e.g. a method wherein after heat treatment, a soluble content is extracted with a certain specific solvent, or a method wherein it is hydrogenated in the presence of a hydrogen donative solvent or hydrogen gas.

In the present invention, it is advisable to employ carbonaceous material which contains at least 40%, preferably at least 70%, more preferably at least 90%, of an optically anisotropic structure. For this purpose, the above-mentioned carbonaceous material may be heat-treated usually at a temperature of from 350 to 500° C., preferably from 380 to 450° C., for from 2 minutes to 50 hours, preferably from 5 minutes to 5 hours, in an atmosphere of an inert gas such as nitrogen, argon or hydrogen, or while blowing such an inert gas, as the case requires.

In the present invention, the proportion of the optically anisotropic structure of pitch is the proportion of the area of the portion showing optical anisotropy in a pitch sample, as observed by polarization microscope at room temperature. Specifically, for example, a pitch sample pulverized to a particle size of a few mm is embedded on substantially the entire surface of a resin with a diameter of 2 cm by a conventional method, and the surface is polished. Then, the entire surface is observed under a polarization microscope (100 magnifications), whereby the proportion of the area of the optically anisotropic portion in the entire surface area of the sample is measured.

As a result of various studies conducted prior to preparing carbon fibers having high thermal conductivity, it has been found that the thermal conductivity of carbon fibers is governed solely by the size of graphite crystallites constituting the carbon fibers. Namely, with carbon fibers, irrespective of the starting material or the process for their production, the larger the graphite crystallites, the less scattering of electric and thermal carriers due to lattice defects tends, and the larger the thermal conductivity becomes.

On the other hand, the tensile modulus of elasticity and compression strength of pitch based carbon fibers are governed by the structure of agglomerates of the above-mentioned graphite crystallites i.e. "the tissue structure" evaluated by a size of a level of from 0.1 μm to 100 μm (Fundamentals of Chemical Engineering of Carbon, edited by Sugiro Otani and Yuzo Sanada, published by Ohm Company (1980) 130). Namely, large voids present at so-called boundaries of structural bodies larger than the size of crystallites govern the strength. Accordingly, in order to obtain a high compression strength of at least 35 kg/mm$^2$ and a high tensile modulus of elasticity of at least 85 ton/mm$^2$ as in the case of carbon fibers of the present invention, it is necessary to minimize and reduce such voids.

This "tissue structure" can be observed by a scanning electron microscope as enlarged to from 4,000 to 10,000 magnifications, or can be observed by a polarization microscope as a "domain" enlarged to from 4,00 to 1,500 magnifications. With the carbon fiber of the preset invention, when the cross section in the direction of fiber axis is observed with 1,000 magnifications, it consists substantially of a domain of at most 500 nm, preferably at most 4,00 nm, more preferably at most 350 nm.

Taking into consideration the facts that with carbon fibers, as the orientation in the direction of pitch fiber axis is good at the stage of a pitch fiber, graphite crystallites of carbon fiber tend to be large in the subsequent carbonization or graphitization step and if the "tissue structure" or "domain" of the carbon fiber becomes too large, the properties with respect to strength tend to be low. It is important to use a pitch having good orientation in the spinning step and to take due care so that the pitch fiber will not have an unduly large "domain". Specifically it is necessary to control domain size to a level of not more than 500 nm. For this purpose, it is advisable to increase the orientation of pitch molecules at the time of spinning a pitch fiber from the above-mentioned pitch and to conduct spinning at such a temperature that the viscosity of the spinning pitch at the spinning nozzle would be at most 150 poise to minimize a disturbance of orientation by stretching, to obtain a pitch fiber having excellent orientation. The temperature at that time is usually preferably within a range of from +32° C. as a Metler softening point temperature of a usual pitch to a temperature of +45° C., preferably within a range of +36° C. as the Metler softening point temperature to a temperature of +42° C.

Further, it is preferred to provide a filler material in the nozzle hole to separate pathways of the liquid crystal pitch so as to reduce the domain size. As such as filler material, it is possible to employ a filter of from 40 to 2,000 mesh, preferably from 100 to 1,000 mesh. This filler material may be of any material so long as it has a function to divide pathways in the nozzle hole. For example, it may be metal or ceramics glass beads, or it may be e.g. a metal powder which is useful as a shearing filter material.

The pitch fiber thus obtained may be infusibilized in accordance with a conventional method and carbonated and/or graphitized at a desired temperature to obtain a "a starting material carbon fiber" for the carbon fiber of the present invention.

Specifically, a pitch fiber is heat-treated at from 300° C. to 380° C. in an oxidizing gas atmosphere to obtain an infusible tow. Further, this infusible fiber tow is carbonized or graphitized usually from 800° C. to 3,000° C. in an inert gas atmosphere of e.g. nitrogen or argon. This carbonization or graphitization treatment is carried out at such a temperature that the carbon content of the resulting carbonized or graphitized fiber will be at least 97%, preferably at least 99%. By the treatment at such a temperature, it is possible to minimize the dimensional change due to carbonization shrinkage of the carbon fiber in the subsequent step of graphitization treatment and to prevent a decrease in the carbon fiber strength due to a damage to the fiber.

Then, surface treatment is conducted by a conventional method, and then a sizing agent is applied in an amount of from 0.2 to 10 wt%, preferably from 0.5 to 7 wt%, to the fiber, to obtain a carbon fiber.

As the sizing agent, a commonly employed optional agent may be employed. Specifically, an epoxy compound, a water-soluble polyamide compound, a saturated or unsaturated polyester, vinyl acetate, water, or an alcohol, glycol alone or a mixture thereof, may be mentioned.

Further, in order to obtain the carbon fiber woven fabric of the present invention, the above-mentioned "starting material carbon fiber" tow is preliminarily subjected to plain weave of satin weave by means of e.g. a shuttle loom or a repier loom to obtain a "starting material carbon fiber fabric" having a FAW (Fiber Areal Weight i.e. the weight per unit are of the fabric) of from 50 to 250 g/m$^2$.

Then, in the present invention, the above-mentioned "starting material carbon fiber" or "starting material carbon fiber fabric" is put into a crucible made of graphite together with preliminarily graphitized packing coke, followed by graphitization treatment.

The graphite crucible is not particularly limited with respect to the size or shape, so long as it is capable of accommodating a desired amount of the above carbon fiber or carbon fiber fabric. However, in order to prevent damages to the carbon fiber or carbon fiber fabric due to the reaction with an oxidizing gas or carbon vapor in the baking furnace during the graphitization treatment or during cooling, it is preferred to have a cover and high air-tightness.

The carbon fiber or carbon fiber fabric is charged into the graphite crucible as wound on a bobbin or a core material. The packing coke to be charged together into the graphite crucible, is the one preliminarily graphitized. Such a graphitization temperature is required to be at least at a temperature at which removal of the volatile component of the packing coke would be accomplished, and it is the one graphitized at a temperature of from 1,400° C. to 3,500° C., preferably from 2,500° C. to 3,500° C.

The particle size is from 0.1 mm to 100 mm, preferably from 5 mm to 30 mm, as an average particle size. The graphitization treatment is carried out at a temperature of from 2,500° C. to 3,500° C., preferably from 2,800° C. to 3,300° C., more preferably from 2,900° C. to 3,100° C.

As the equipment for the graphitization treatment, it is particularly preferred to employ an Acheson resistance heating furnace from the viewpoint of production efficiency. However, there is no particular restriction, so long as the equipment is the one capable of treating at a temperature of at least 2,500° C. and the above-mentioned graphite crucible can be placed in the heating furnace.

The graphitization time is such that the retention time at a temperature of at least 2,500° C. is from one hour to 300 days, preferably from 4 hours to 30 days.

Thus, the carbon fiber or carbon fiber fabric of the present invention can be obtained.

The carbon fiber thus obtained will easily be a carbon fiber having a tensile modulus of elasticity of at least 85 ton/mm$^2$, a compression strength of at least 35 kg/mm$^2$ and a thermal conductivity in the direction of fiber axis of from 500 to 1,500 W/m·K. Further, the laminated layer thickness Lc of graphite crystallites in the carbon fiber is from 30 to 50 nm, and the ratio thereto of the spread La of the graphite crystallites in the direction of the layer plane (La/Lc) is at least 1.5 times, preferably at least 1.6 times. The domain size of the cross section in the direction of fiber axis is at least 500 nm, as measured by a method which is described hereinafter. Further, it is possible to obtain the one having a tensile strength of at least 360 kg/mm$^2$, preferably at least 4,00 kg/mm$^2$.

Further, by impregnating a thermosetting resin to such a carbon fiber or a carbon fiber fabric in accordance with a conventional method, it is possible to obtain a prepreg or carbon fiber reinforced resin which is excellent in heat resistance (excellent in heat-dissipating property) and high strength or which can be made into a product of light weight.

Such a prepreg or carbon fiber reinforced resin has high thermal conductivity and accordingly can be utilized particularly advantageously for an IC substrate for which a temperature rise is directly connected to breakage of the element or a deterioration in the efficiency, for a solar cell substrate, for the main body of an artificial satellite or for parts for aircrafts. Particularly, it exhibits excellent effects as a solar cell substrate for a space ship, for which all of the strength, light weight and high thermal conductivity of the carbon fiber reinforced resin are required.

EXAMPLES

Figure 1:
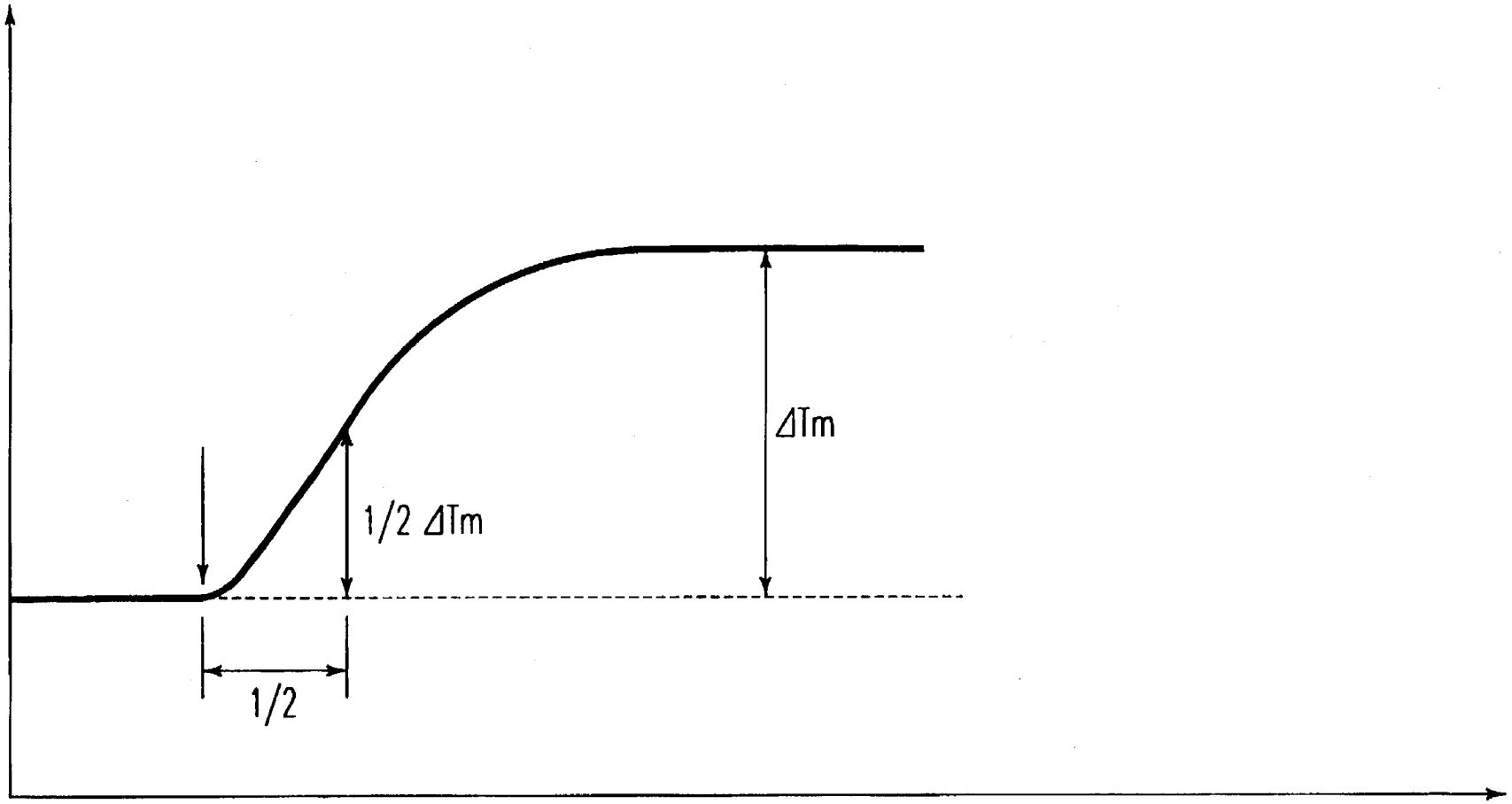
FIG. 1 is a graph showing a relation between the temperature on the rear side of a test sample and the time passed after irradiation with a laser, at the time of determining the thermal conductivity by means of a thermal constant measuring apparatus TC-3000 by a laser flash method, manufactured by Sinkuriko K.K., in the Examples of the present invention.

Now, the present invention will be described in further detail with reference to Examples. However, the present invention is by no means restricted to such Examples unless it exceeds the gist thereof.

The laminated layer thickness Lc of graphite crystallites and the spread La of graphite crystallites in the direction of the layer plane in the Examples were obtained from the (002) diffraction and the (110) diffraction of graphite by "Method for Measuring the Lattice Constant and the Crystallite Size of Artificial Graphite" (Sugiro Otani et al. Carbon Fibers, published by Kindai Henshu (1986) p. 733–740) stipulated by the 117th committee meeting of Nippon Gakujutsu Shinkokai.

To determine the domain size, a carbon fiber is embedded in a resin, and a test sample is molded so that the cross section parallel to the direction of the carbon fiber axis will be the front surface, and after polishing, the domain size is measured under polarization microscope with 1,000 magnifications. While rotating the test sample on a sample table for at least 10° each time under the polarization microscope, the domain size is obtained as an average value of the respective widths of bright and dark portions observed in the form of strips in the direction of carbon fiber axis at the respective angles.

To determine the thermal conductivity, a carbon fiber is made into a disk-shaped one directional carbon fiber reinforced plastic (CFRP) having a diameter of 10 mm and a thickness of from 10 to 6 mm, and the specific heat and the diffusivity of heat of the CFRP are measured by thermal constant measuring apparatus TC-3000 by laser flash method, manufactured by Shinkuriko K.K., whereupon the thermal conductivity is calculated by the following formula:

$$K=Cp\cdot\alpha\cdot\rho/Vf$$

where K is the thermal conductivity of the carbon fiber, Cp is the specific heat of the CFRP, $\alpha$ is the diffusivity of heat of the CFRP, $\rho$ is the density of the CFRP, and Vf is the volume fraction of the carbon fiber contained in the CFRP.

The thickness of the CFRP was changed depending upon the thermal conductivity of the carbon fiber. A test sample with a high thermal conductivity was made thick, and a test sample with a low thermal conductivity was made thin. Specifically, it takes about a few tens msec until the temperature of the rear side of the test sample increases to the maximum temperature after irradiation with a laser, and the thickness of CFRP was adjusted so that the time $t_{1/2}$ until the temperature rises to ½ of the temperature rising width $\Delta$ Tm at that time, would be at least 10 msec (the maximum: 15 msec) (See FIG. 1).

The specific heat was determined by bonding glassy carbon as a light-receiving plate to the front side of a test sample and measuring the temperature rise after irradiation with a laser, by a R thermocouple bonded to the center of the rear side of the test sample. The measured value was corrected by using sapphire as the standard sample.

The diffusivity of heat was determined by forming a covering film on both sides of a test sample by a carbon spray until the surface became invisible and measuring the temperature change on the rear side of the test sample after irradiation of a laser, by an infrared ray detector.

Further, the thermal conductivity of the carbon fiber can also be determined from the electrical conductivity by utilizing a very good interrelation between the thermal conductivity and the electrical conductivity of the carbon fiber.

Example 1

From coal tar pitch, a mesophase pitch having a proportion of optical anisotropy of 100% as observed under a polarization microscope and a softening point of 302° C. as determined by a Metler method, was prepared.

This mesophase pitch was spun by means of a spinneret having 2000 holes nozzle and having a filter of 400 mesh provided at the narrowest portion of each holes, with the nozzle diameter being 0.1 mm at the outlet of each hole, at a spinning temperature of 340° C. and a melt viscosity of 120 poise at the outlet of each spinning nozzle, to obtain a pitch fiber filament having a diameter of 12 μm.

This pitch fiber was heated slowly, at a rate of about 1° C./min to 360° C. in air for heat-treatment to obtain an infusible fiber. Further, this infusible fiber was baked for preliminary graphitization to the maximum temperature of 2,700° C. in an inert gas.

The carbon content of this product was at least 99%. Then, the product was surface-treated and then an epoxy-type sizing agent was applied 2% to obtain a starting material carbon fiber tow. This starting material carbon fiber had a fiber diameter of 9 μm, a strand tensile modulus of elasticity of 78 t/mm$^2$, a strand tensile strength of 390 kg/mm$^2$ and a thermal conductivity of 290 W/m·K.

This carbon fiber was wound up on a graphite bobbin, and this was put into a graphite crucible in such a manner that it was embedded in a preliminarily graphitized packing coke and then graphitized at 3,000° C. by an Acheson resistance heating furnace. As a result, the fiber diameter was 9 μm, the thermal conductivity was 640 W/m·K, the strand tensile modulus of elasticity was 96 t/mm$^2$, the strand tensile strength was 440 kg/mm$^2$, the compression strength of FRP with Vf 60% was 40 kg/mm$^2$ as measured by ASTM D3410 method.

Further, X-ray parameter Lc of graphite crystallites of this carbon fiber was 350 Å, La/Lc=1.75, and the domain size was 330 nm.

Example 2

In the same manner as in Example 1, a pitch fiber filament having a diameter of 9.5 μm was obtained. This pitch fiber was subjected to infusible treatment, followed by baking to the maximum temperature of 2,700° C. in an inert gas atmosphere, for preliminary graphitization.

The carbon content of this product was at least 99%. Then, the product was surface-treated, and an epoxy type sizing agent was applied 2% to obtain a starting material carbon fiber tow. This starting material carbon fiber had a fiber diameter of 7 μm, a strand tensile modulus of elasticity of 79 t/mm$^2$, a strand tensile strength of 380 kg/mm$^2$ and a thermal conductivity of 240 W/m·K.

This starting material carbon fiber tow was woven by means of a repier loom to obtain a starting material carbon fiber woven fabric having a FAW of 80 g/m$^2$. Then, this starting material carbon fiber fabric was further wound up on a graphite bobbin, and this was put into a graphite crucible so that it would be embedded in a preliminarily graphitized packing coke and graphitized at 3,000° C. by an Acheson resistance heating furnace. FAW of the obtained carbon fiber fabric was 82 g/m$^2$.

The carbon fiber of this woven fabric had a fiber diameter of 7 μm, a thermal conductivity of 600 W/m·K, a tensile modulus of elasticity of 89 t/mm$^2$, a tensile of 390 kg/mm$^2$, and X-ray parameter Lc of graphite crystallite of 33 nm, La/Lc=1.7 and a domain size of 330 nm.

To this carbon fiber fabric, a thermosetting resin was impregnated, followed by molding and curing, whereby the flexural modulus of elasticity of the composite with Vf=50%, was 19 t/mm$^2$.

In order to use such a composite material as a solar cell substrate for an artificial satellite, two sheets of a solar cell substrate having a size of 10×2 m were prepared. Each substrate has such a composite material on both sides, and one composite material had two sheets of carbon fiber cloth laminated. Accordingly, the employed carbon fiber cloths had a size of 10×2 (area per sheet)×2 (number of cloth sheets per composite material)×2 (front side and rear side)×2 (an artificial satellite usually has two sheets of a solar cell)=160 m$^2$.

The weight of the two sheets of the solar cell substrate was about 20 kg.

Effect for the Invention

A carbon fiber having high thermal conductivity, high tensile modulus of elasticity and high compression strength simultaneously, and various materials employing it, can be provided.

What is claimed is:

1. A pitch based carbon fiber having a thermal conductivity in the direction of fiber axis of from 500 to 1,500 W/m·K, a tensile modulus of at least 85 ton/mm$^2$, a compression strength of at least 35 kg/mm$^2$, a laminated layer thickness, Lc, of graphite crystallites of from 30 to 50 nm, the ratio thereto of a spread, La, of graphite crystallites in the direction of layer plane, La/Lc, of at least 1.5, and when a cross section of said fiber in the direction of fiber axis is observed by a polarization microscope with 1,000×magnifications, the domain size as observed is at most 500 nm.

2. The pitch based carbon fiber according to claim 1, characterized in that the tensile strength is at least 360 kg/mm$^2$.

3. A carbon fiber woven fabric prepared by weaving a tow comprising the pitch based carbon fibers of claim 1 or 2, wherein said fabric has a weight of the woven fabric per unit area, FAW, of 50 to 250 g/mm$^2$.

4. A prepreg having a thermosetting resin impregnated into a carbon fiber of claim 1 or 2.

5. A prepreg having a thermosetting resin impregnated into a carbon fiber woven fabric of claim 3.

* * * * *